United States Patent [19]

Hinotani et al.

[11] Patent Number: 4,764,706

[45] Date of Patent: Aug. 16, 1988

[54] FLAT CATHODE-RAY TUBE AND METHOD OF FABRICATING SAME

[75] Inventors: Katsuhiro Hinotani, Shijyonawate; Hajime Hayama, Nara; Shunichi Kishimoto, Kaizuka; Takashi Miwa, Higashiosaka; Yasuo Funazo, Toyonaka; Kazuhiro Kouno, Hirakata, all of Japan

[73] Assignee: Sanyo Electric Co., Ltd., Osaka, Japan

[21] Appl. No.: 36,177

[22] Filed: Apr. 8, 1987

Related U.S. Application Data

[63] Continuation-in-part of Ser. No. 776,268, Sep. 16, 1985, abandoned.

[30] Foreign Application Priority Data

Sep. 17, 1984 [JP] Japan ..... 59-194127
Sep. 28, 1984 [JP] Japan ..... 59-147415[U]

[51] Int. Cl.[4] ..... H01J 29/86; H01J 9/24
[52] U.S. Cl. ..... 313/422; 313/471; 313/477 R; 445/22
[58] Field of Search ..... 313/422, 477 R, 471; 445/22

[56] References Cited

U.S. PATENT DOCUMENTS 4,588,430 5/1986 Sumiyoshi et al. ..... 313/477 R X
4,654,559 3/1987 Hinotani et al. ..... 313/471 X

OTHER PUBLICATIONS

"Wide Screen CFT Display", by Ohta, pp. 26 to 29, published by The Journal of the Institute of Television Engineers on Japan, vol. 38 No. 1, issued on Jan. 20, 1984.

*Primary Examiner*—Palmer C. DeMeo
*Attorney, Agent, or Firm*—Armstrong, Nikaido, Marmelstein & Kubovcik

[57] ABSTRACT

A flat CRT having a phosphor screen inclined with respect to the center axis of an electron beam and formed by applying phosphors to the inner surface of a tube wall. The tube inner surface is defined by rotating a plurality of logarithmic spiral curves having a constant angle of incidence and present in the x-y plane of a polar coordinate system in which the deflection center of the electron beam is its origin, the center axis extends through the origin and serves as the x-axis, and the y-axis extends through the origin and intersects the x-axis at right angles therewith. The spiral curves are rotated about the y-axis each through a specified angle to obtain a group of logarithmic curves defining the tube inner surface.

10 Claims, 3 Drawing Sheets

FLAT CATHODE-RAY TUBE AND METHOD OF FABRICATING SAME

This application is a continuation-in-part of application Ser. No. 776,268 filed Sept. 16, 1985 now abandoned.

TECHNICAL FIELD

The present invention relates to a flat cathode-ray tube (hereinafter referred to as "CRT") and to a method of fabricating the same.

PRIOR ART

CRTs used for television receivers, etc. are generally so designed that an electron gun disposed on an axis perpendicular to the phosphor screen scans the phosphor screen through a metallic layer.

Accordingly, the CRT has a large head, in addition to a large length. The receiver itself is therefore large-sized because the size of the receiver is generally dependent on the volume of the CRT, i.e. the area of the phosphor screen multiplied by the length of the CRT. This poses a great problem when designing a compact thin television receiver.

Flat CRTs have been proposed which have a phosphor screen inclined with respect to the center axis of the electron beam and in which differences in the distance of travel of the beam produce little or no difference in the diameter of the spot or in the resolution. With such CRTs, however, the variation in the angle of incidence of the beam on the phosphor screen greatly influences the resolution.

We have proposed a flat CRT wherein the electron beam is incident on the phosphor screen at a constant angle as disclosed in Japanese Patent Application SHO No. 58-125101 (filed on July 8, 1983, published on Jan. 29, 1985, Publication Number SHO No. 60-17841). The proposed CRT will be described below with reference to FIGS. 5 to 7.

FIG. 7 is a sectional view schematically showing the construction of the CRT. The neck 2 of a flat glass tube 1 has an electron gun 3 enclosed therein and is externally provided with deflection coils 4. A phosphor screen 5 provided on the inner surface of a first panel 8 is inclined with respect to the center axis 7 of an electron beam 6 (i.e., to the direction of propagation of the beam 6 when it is not deflected), and the center axis 7 intersects the screen 5 approximatelv at its center. The electron beam 6 emitted by the gun 3 is horizontally and vertically deflected by the coils 4 and causes the phosphor screen 5 to luminesce by excitation, enabling the viewer to observe the luminescent phosphor screen 5 through a window 29 formed in a second panel 9.

The phosphor screen 5 is fabricated using CAD (computer aided design) and CAM (computer aided manufacturing) by the following method so that the electron beam 6 will be incident on the sceen 5 at a constant angle over the entire area of the screen 5.

While the method of shaping the inner surface of the panel 8 providing a base for the phosphor screen 5 will be described below, it will be readily understood that the shape of the phosphor screen 5 formed by arranging specified phosphors, etc. on the panel inner surface is substantially identical with the shape of the panel inner surface.

With reference to FIG. 6, a polar coordinate system is considered wherein the origin is the deflection center A of the CRT (see FIG. 7), the x-axis is the center axis of the electron beam through the center A, and the y-axis intersects the x-axis at right angles therewith and extends through the origin A in the direction of vertical deflection.

A logarithmic spiral curve l in the x-y plane is represented by the following equation.

$$r=ae^{k\theta}$$

wherein r is the distance of a point on the curve from the origin A, a is a constant, e is the base of natural logarithm, and k is $1/\tan\phi$ where $\phi$ is the angle a tangent to the curve at the point makes with a straight line extending from the origin to the point.

The base for the phosphor screen is shaped in conformity with the shape of the above logarithmic spiral curve.

With reference to FIG. 6, P1 and P2 are points on the logarithmic spiral curve l, and are the points at the upper and lower ends of the screen base in the x-y plane.

T1 and T2 are tangents to the spiral curve l at the points P1 and P2, respectively.

r1 and r2 are the distances of the points P1 and P2 from the origin A, respectively, and $\phi_1$ and $\phi_2$ are the angle the line r1 makes with T1 and the angle the line r2 makes with T2, respectively, these angles being the angle of incidence of the beam on the screen base at P1 and P2.

The logarithmic spiral curve l is such that a straight line through any optional point on the curve and the origin A makes a constant angle with the tangent to the curve at that point.

Accordingly, the electron beam from the deflection center A is incident on any point on the curve always at a constant angle.

To complete the phosphor screen base, the segment of curve P1P2 is rotated about the y-axis, and the locus obtained, i.e., curved surface S, is used as the base as shown in FIG. 5. Accordingly, the angle of incidence of the beam from the deflection center A on any point on the curved surface S is perfectly constant. Thus, the angle of incidence of the electron beam on a phosphor screen shaped in conformity with such a shape is completely constant at any point on the phosphor screen.

As the phosphor screen base approaches a plane, the flat CRT becomes thinner. This assures a greater advantage in fabricating a curved panel and also in coating the panel with phosphors, etc.

However, according to the method of forming the phosphor screen base described wherein a segment of single logarithmic spiral curve is rotated about the y-axis, the rotation produces a difference in the direction of thickness of the phosphor screen between a curve lC at the center of the curved surface and curves lR and lL at the opposite ends thereof, posing difficulties in realizing flat CRTs. For reference, Published Examined Japanese Patent Application SHO No. 42-7491 also discloses a flat CRT wherein the phosphor screen is prepared by the same method as above.

Further when the phosphor screen is shaped in conformity with a curved surface traced merely by a single logarithmic spiral curve rotated about the y-axis, the raster formed by the scan of electron beam is sectorial or fan-shaped as seen in FIG. 4 to result in vertical deflection distortion and horizontal deflection distortion.

When such vertical deflection distortion occurs in the raster, the beam-indexing color flat CRT, for example, encounters the following objection.

FIG. 11 shows the structure of the phosphor screen of this type of CRT. The phosphor screen comprises index phosphor stripes I and red, green, blue primary color phosphor stripes R, G, B. (The red color phosphor stripes are identified by circle marks, the green ones by cross marks, and the blue ones by triangle marks.) The stripes I, R, G, B extend in the direction of vertical deflection and have the same length.

Suppose vertical deflection distortions occurred as indicated by solid lines EE, FF, GG and HH. In the case of the vertical deflection distortions indicated by lines EE and FF, the electron beam is unable to fully excite the index phosphor stripes in the areas above the lines EE and FF, while in the case of vertical deflection raser distortions indicated by the lines GG and HH, the beam is unable to completely excite the index phosphor stripes in the areas below the lines GG and HH. For example, it is assumed that in the event of the vertical deflection distortion as indicated by the line FF, the electron beam scans as indicated by a line FF' on the upper side of the line FF. The beam is then unable to scan the third index phosphor stripe II' from the left to result in a lack of index signal and subsequently disturb color reproduction, failing to reproduce a satisfactory image over the entire effective image area.

FIG. 10 shows a fan-shaped raster 12 having vertical deflection distortions 12*a*, 12*a* and horizontal deflection distortions 12*b*, 12*b*. For the reason given above, these deflection distortions must be corrected to produce a rectangular raster 17 as shown in broken line in FIG. 10.

For the correction of the fan-shaped raster to the rectangular raster, the vertical deflection sawtooth current and the horizontal deflection sawtooth current need to be corrected by driving a correction circuit. This requires great power consumption. Especially when the flat CRT is incorporated into a compact thin pocketable television receiver, the increased power consumption is disadvantageous because the television circuit is driven by cells.

SUMMARY OF THE INVENTION

An object of the present invention is to provide a flat CRT wherein the electron beam is made incident on the phosphor screen at a constant angle at any point on the screen, and the phosphor screen is made approximate to a plane to the greatest possible extent.

Another object of the present invention is to provide a method of forming a phosphor screen for the CRTs of television receivers or the like, the phosphor screen being so adapted that the electron beam is made incident thereon at a constant angle at any point and being made approximate to a plane to the greatest possible extent.

The CRT of the present invention has a phosphor screen which is defined by a group of logarithmic spiral curves obtained by drawing a plurality of logarithmic spiral curves in an x-y plane and rotating each of the spiral curves about the y-axis through a specified angle.

The CRT of the present invention has a phosphor screen which is produced by drawing a plurality of logarithmic spiral curves in an x-y plane, rotating each of the spiral curves about the y-axis through a specified angle to obtain a group of logarithmic spiral curves defining a base for the phosphor screen, and applying phosphors and the like to the base.

Another object of the present invention is to provide a color CRT which is adapted to satisfactorily reproduce color images even in the presence of vertical deflection distortions.

The present invention provides a color flat CRT having a phosphor screen wherein the index phosphor stripes are longer than the primary color triplet phosphor stripes.

DETAILED DESCRIPTION OF THE INVENTION

An embodiment of the present invention will be described first with reference to FIGS. 1 to 4. The tube wall is physically shaped utilizing a CAD system (computer aided design) as is well known in the art. The tube wall is constructed from glass. In order to shape a tube wall utilizing a CAD, data is input into the computer in order to provide a plurality of logarithmic curves. The computer converts the plurality of logarithmic sprial curves into an image of a plane. The resulting image of the plane is made into a mold using a NC (numerically controlled) machine. Molten glass is then poured into the mold and the glass is press-formed into the particular shape of the tube wall. Thus, the tube wall according to the present invention, can be physically shaped by utilizing a CAD system (computer aided design). Application of the CAD system to the design of a CRT is known, for example, by Yasuo Ohta, "Wide Screen CRT Display," "The Journal of the Institute of Television Engineers of Japan", Vol. 38, No. 1, page 27 (Jan. 1984). Ohta desribes the design of a super-wide glass tube and processing a press mold using CAD and CAM (computer aided manufacturing.) The structure of the flat glass tube other than the shape of a base for the phosphor screen is the same as that shown in FIG. 7 and therefore will not be described.

Figure 3:
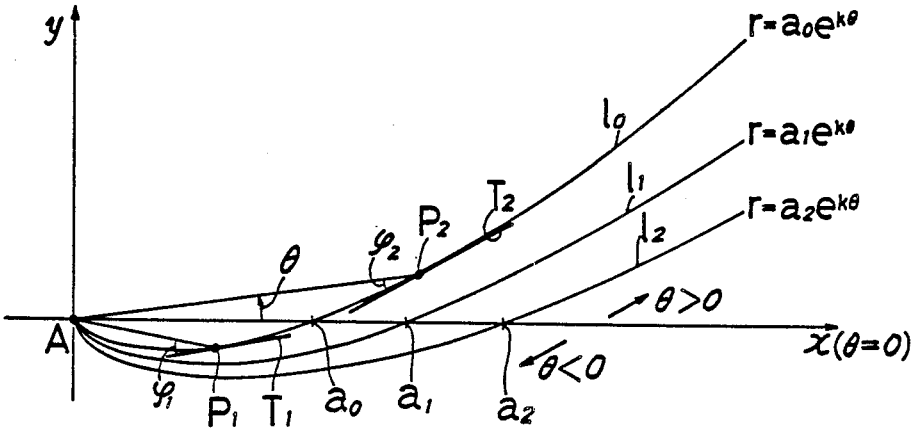
FIG. 3 is a diagram showing a group of curves used for the method.
Figure 6:
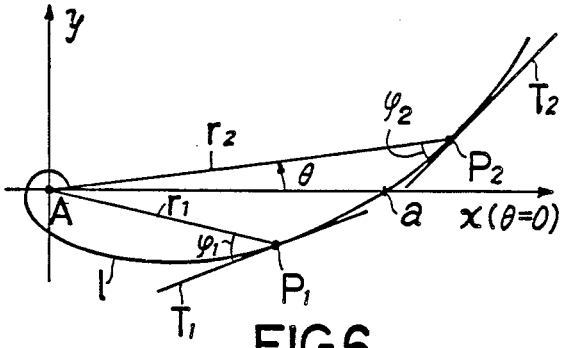
FIG. 6 is a diagram for illustrating a logarithmic spiral curve.

FIG. 3 shows the logarithmic spiral curve of FIG. 6 as simplified.

The logarithmic spiral curve is such that a line through any point on the curve and the origin A makes a constant angle with a tangent to the curve at that point. When the beam incidence surface of the phosphor screen is shaped in conformity with the shape of this curve, the angle of incidence of the electron beam on the phosphor surface is constant at any point as already described.

Under the condition that the angle of incidence $\phi$ is constant (that is, k is constant), there are numerous logarithmic spiral curves in the x-y plane where the deflection center is the origin A.

When logarithmic spiral curves are expressed by the equation $r=a_i e^{k\theta}$ wherein k is constant and distance $a_i$ is variable as a parameter, an indefinite number of logarithmic spiral curves can be drawn in the same plane (x-y plane). FIG. 3 typically shows logarithmic spiral curves $r=a_0e^{k\theta}, r=a_1e^{k\theta}$ and $r=a_2e^{k\theta}$ extending through points on the x-axis at distances $a_0$, $a_1$ and $a_2$ from the origin, respectively. These curves are indicated at l0, l1 and l2, respectively.

In FIG. 3, the intersection of the x-axis and the logarithmic curve is taken as the reference point ($\theta=0$), and $\theta$ is variable in the directions of arrows shown.

According to the present invention, such logarithmic curves present in the x-y plane are utilized for shaping the phsophor screen. This method will be described below.

Figure 2:
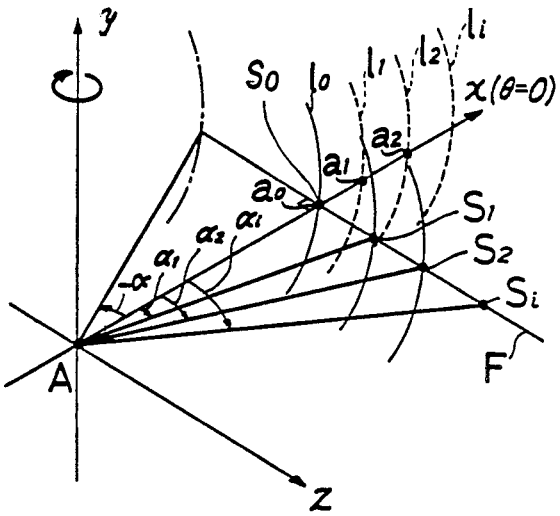
FIG. 2 is a diagram showing the method of shaping the raster of FIG. 1.

With reference to FIG. 3, the x-y plane contains a logarithmic spiral curve $r=a_0e^{k\theta}$ and a plurality of logarithmic spiral curves $r=a_1e^{k\theta}, r=a_2e^{k\theta}, \ldots$ wherein $a_1, a_2, \ldots$ is larger than $a_0$. With the curve $r=a_0e^{k\theta}$ fixedly positioned in the x-y plane as a reference, the other curves are rotated about the y-axis through an angle $\alpha$ which is greater when the parameter $a_i$ is larger. Thus, $a_2>a_1>a_0$, while $|\alpha_2|>|\alpha_1|>|\alpha_0|(=0)$. FIG. 2 shows this mode of rotation. The method of shaping the desired curved surface will be described in detail below.

FIG. 2 shows a point S0 on the x-axis which point is at a distance of $a_0$ from the origin and a straight line F intersecting the x-axis at right angles therewith at the point S0 in the x-z plane. The curved surfaces traced by the logarithmic spiral curves l1, l2, l3 rotated about the y-axis intersect the line F at points Si, S2, S3, respectively. The coordinates of the points S0, S1, S2, Si in the x-z plane are expressed by S0($a_0$, 0), S1($a_1 \cos \alpha_1$, $a_1 \sin \alpha_1$), S2($a_2 \cos \alpha_2$, $a_2 \sin \alpha_2$), Si($a_i \cos \alpha_i$, ai $\sin \alpha_i$). Of these coordinates (x, z), the x-coordinates are on the line F at a distance of $a_0$ from the origin and are therefore all $a_0$. Accordingly, the angles $\alpha_1$, $\alpha_2$, $\alpha_3$ through which the logarithmic spiral curves are to be rotated about the y-axis can be determined from the relations of $a_1 \cos \alpha_1=a_0$, $a_2 \cos \alpha_2=a_0$, $a_i \cos \alpha_i=a_0$. Further when the angles $\alpha_1$, $\alpha_2$, $\alpha_3$ are preset to stepwise varying values, the parameters $a_1$, $a_2$, $a_i$ of the spiral curves l1, l2, li to be used for shaping the phosphor screen can be determined.

When the rotation angles are decreased indefinitely, S0, S1, S2, . . . , Si become continuous, that is, a continuous surface is generated by the rotation of spiral curves l0, l1, l2, . . . , li. Consequently, a base for the phosphor screen is obtained which is made approximate to a plane to the greatest possible extent.

According to a preferred embodiment, logarithmic spiral curves were rotated through angles increasing stepwise by 0.5 degree at a time, i.e., through $\alpha_1=0.5$ degree, $\alpha_2=1$ degree, $\alpha_3=1.5$ degrees, . . . , whereby a surface shape was obtained which was defined by substantially continuous spiral curves entirely for use as the base of phosphor screen.

Figure 1:
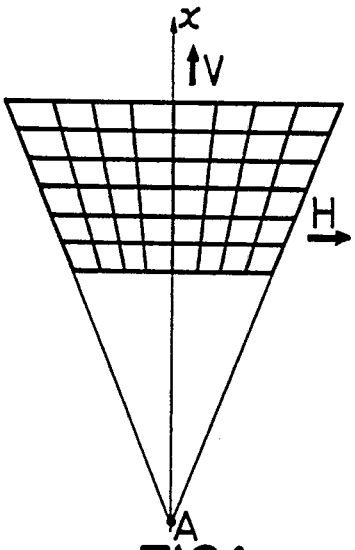
FIG. 1 is a diagram showing the shape of a raster on a phosphor screen which is shaped in conformity with a curved surface obtained by rotating a plurality of logarithmic spiral curves each through a specified angle.

The raster formed by an electron beam on the curved surface thus obtained as a phosphor screen is trapezoidal and free of vertical deflection distortions as seen in FIG. 1.

When the spiral curve is rotated about the y-axis through an angle $\alpha_i$ having the relation of $a_i=1/\cos \alpha_i \cdot a_0$, the shape of phosphor screen obtained is most approximate to a plane, hence most desirable as already mentioned. However, this is not limitative; it will be understood that a phosphor screen is similarly useful which is obtained by rotating the curve with a relation approximate to $a_i=1/\cos \alpha_i \cdot a_0$, because the screen thus obtained is exceedingly flatter than those of the prior art.

Because the vertical deflection raster distortions can be corrected by virtue of the shape of the phosphor screen without using any correction circuit, horizontal deflection raster distortions only need to be corrected by a correction circuit. This serves to reduce the power consumption and the number of components for compact thin television receivers.

With the mode of rotation shown in FIG. 2, the phosphor screen is formed on only one side of the x-y plane. To form the screen on the other side and obtain the entire screen, the plurality of spiral curves are rotated each through a specified angle in the same manner as above except that the direction of rotation is reversed (to counterclockwise direction).

The raster formed on the phosphor screen thus shaped is free of vertical deflection distortions as seen in FIG. 1, but it is likely that some distortions remain uncorrected due to the distortion of the CRT panel due to errors involved in the design or manufacture of the panel. Further when a correction circuit is adapted to remedy vertical deflection raster distortions on phosphor screens which are fabricated by the conventional method unlike the above method, the variation resulting from the lapse of time or displacement of the deflection yoke, etc. is likely to result in distortions which are not fully correctable. When such a phosphor screen having unremedied vertical deflection distortions is used for beam-indexing color CRTs, the problem already mentioned is encountered.

With the beam-indexing color CRT of the present invention, the index phosphor stripes are made longer than the primary color triplet phosphor stripes so that all the index phosphor stripes can be excited by the electron beam even when the raster develops vertical deflection distortions.

Figure 7:
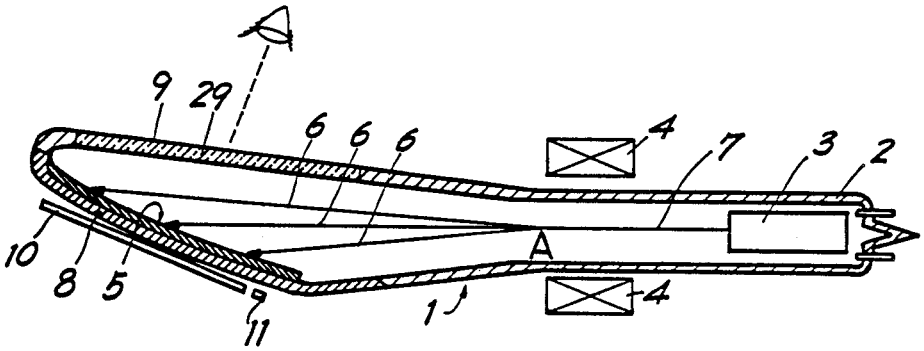
FIG. 7 is a view in section showing a flat CRT.
Figure 4:
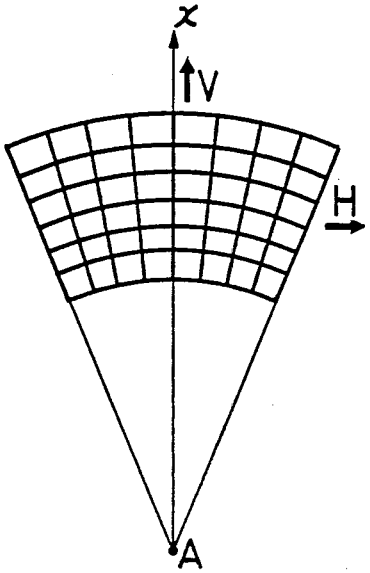
FIG. 4 is a diagram showing a raster shaped by rotating a single logarithmic spiral curve.
Figure 5:
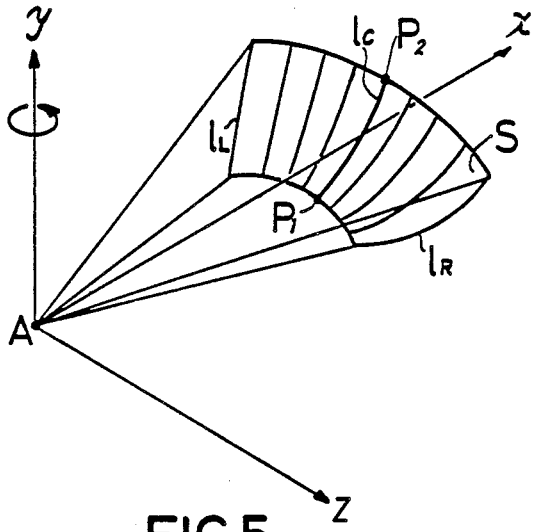
FIG. 5 is a diagram showing the method of shaping the raster of FIG. 4.
Figure 10:
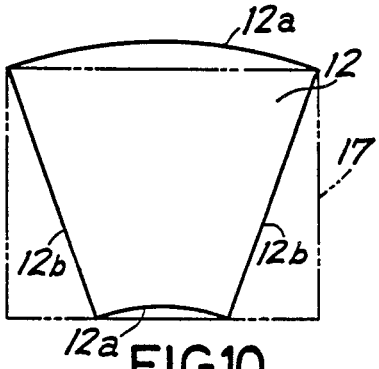
FIG. 10 is a diagram showing distortions of a raster.
Figure 9:
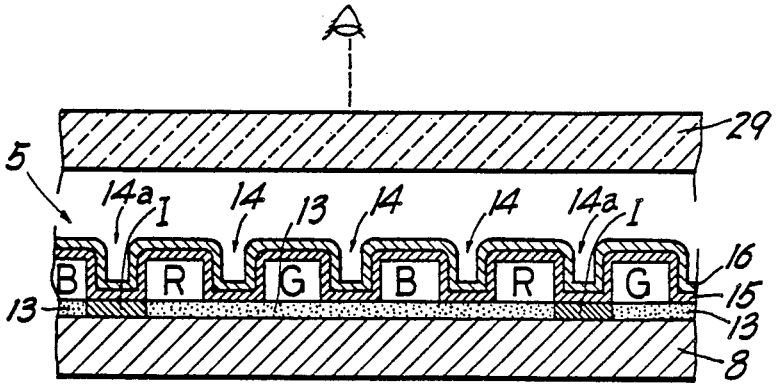
FIG. 9 is an enlarged view in section taken along the line IX—IX in FIG. 8.

The beam-indexing color CRT of the present invention has the following phosphor screen. In FIGS. 7 and 9, a layer 13 of carbon or like black nonluminescent substance is formed in the shape of stripes on the inner surface of a panel 8. Also formed on the panel inner surface are index stripes I of a phosphor such as P47 Phosphor (brand name of $Y_2SiO_5 \cdot Ce$, product of KASEI OPTONICS K.K.), with the layer 13 interposed therebetween. Primary color triplet phosphor stripes R (red), G (green) and B (blue) are arranged at a specified spacing on the nonluminescent substance layer 13 in a definite relation to the index phosphor stripes I which are disposed in some (14*a*) of the spaces 14 between the color phosphor stripes. The color phosphor stripes have a thickness sufficient for these stripes to reach saturation luminance when luminescing to the highest luminance.

With the arrangement described, an electron beam 6 directly excites the color phosphor stripes R, G, B and the index phosphor stripes I, enabling the viewer to observe bright images through an observation window 29 and giving index light of high intensity through the panel 8. Moreover, images of improved contrast ratio can be obtained because the black nonluminescent substance layer 13 is present in the spaces 14 between the color phosphor stripes other than the spaces 14*a* where the index phosphor stripes I are positioned.

Furthermore, the nonluminescent substance layer 13 on which the color phosphor stripes R, G, B are arranged blocks the luminescence of the color phosphors that otherwise would strike a light collector plate 10 through the panel 8, so that only the luminescence of the index phosphor stripes I is emitted toward the collector plate 10. Thus, the index light alone can be separated off effectively. The phosphor screen has another advantage in that it is easy to fabricate because there is no need to form a metallic layer and further because the nonluminescent layer 13 has a large stripe width. The color phosphor stripes R, G, B have a sufficient thickness, so that the deficit of luminance due to the absence of metallic layer can be fully compensated for. With the present embodiment, the phosphor screen is entirely covered with a protective transparent thin film 15 of silicon dioxide ($SiO_2$) for preventing scorching by ions. The film 15 is further covered with a very thin electrically conductive transparent film 16, such as a thin film of ITO (indium oxide doped with tin oxide), formed by vacuum evaporation for preventing the reduction of luminance due to charging. The protective film 15 is several hundred angstroms in thickness, while the conductive film 16 has a thickness of 200 to 300 angstroms. Having such a very small thickness, these films will not substantially attenuate the electron beam.

Figure 8:
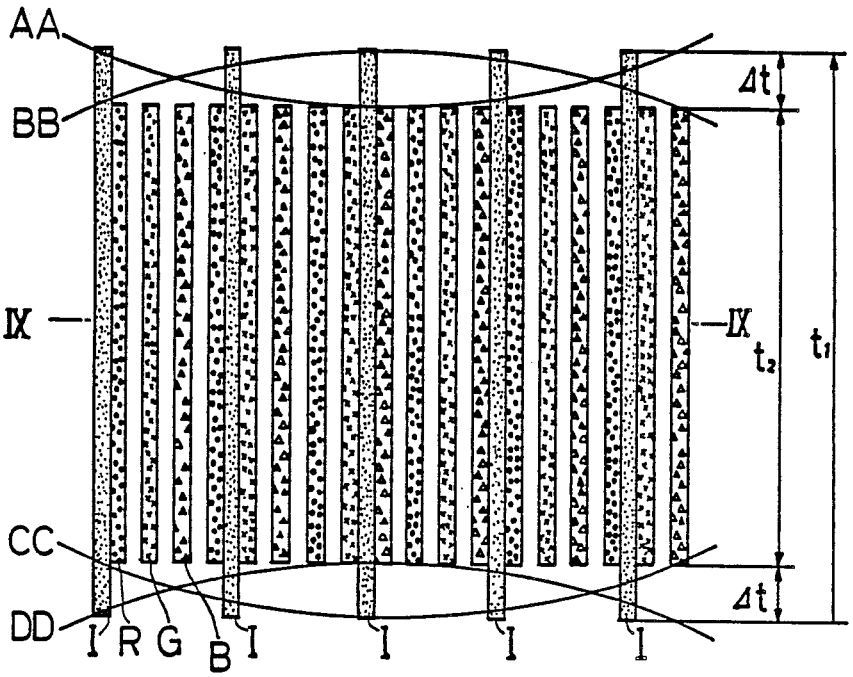
FIG. 8 is a plan view showing the shape of the phosphor screen of a CRT embodying the invention.
Figure 11:
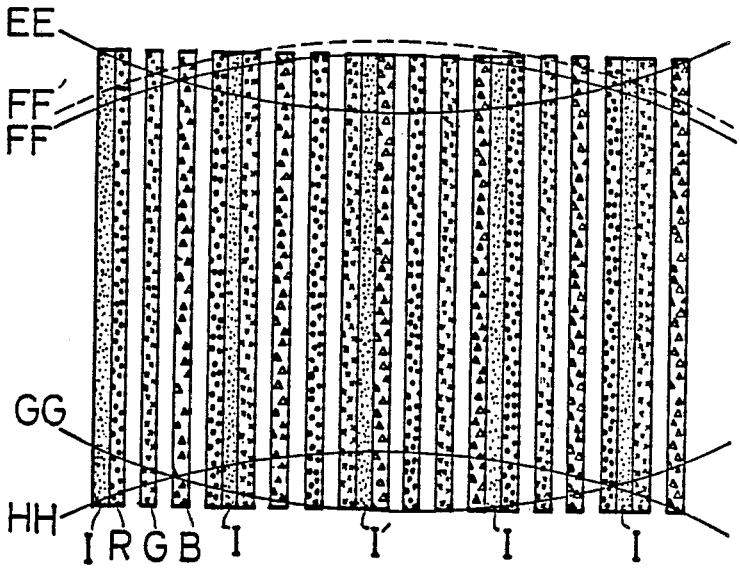
FIG.11 PRIOR ART
FIG. 11 is a plan view showing the shape of a conventional phosphor screen for color flat CRTs.

With reference to FIG. 8, the index phosphor stripes I extend in the direction of vertical deflection beyond the upper and lower portions of the effective image area and have a length t1 larger than the length t2 of the red, green blue primary color phosphor stripes R, G, B. The extensions of the index stripes I have a length $\Delta t$ corresponding to or larger than the amount of vertical deflection distortions of the raster. For example, the length $\Delta t$ is about 1 to about 3% of the length of the color stripes.

With this arrangement, the electron beam excites all the index phosphor stripes I even when vertical deflection distortions occur in the raster as indicated in solid lines AA, BB, CC, DD in FIG. 8 to create no lack in the index signal. Consequently, satisfactory color images can be reproduced over the entire effective image area (where the color phosphor stripes R, G, B are formed). Although the present embodiment wherein the index stripes are elongated has been described with reference to the case wherein the luminescence of the phosphor screen is observed through the tube wall toward the electron beam incidence side, the present arrangement is similarly useful for color flat CRTs of the transparent type wherein the image is observed from outside the tube wall provided with the phosphor screen.

According to the present invention, the angle of incidence of the electron beam is constant over the entire phosphor screen to give images with a uniform resolution. Additionally, the phosphor screen can be made to closely resemble a plane to render the CRT body flatter and easier to fabricate. Thus, the invention is very useful.

The flattened CRT of the present invention is usable of course for both black-and-white television receivers and color television receivers.

The foregoing disclosure and description of the invention are illustrative and explanatory thereof, and various changes in the size, shape and materials, as well as in the details of the illustrated construction may be made without departing from the spirit of the invention.

We claim:

1. A flat CRT comprising:

a phosphor screen inclined with respect to a center axis of an electron beam and formed by applying phosphors to an inner surface of a tube wall serving as a base of the phosphor screen, the tube wall having the inner surface defined by a curved surface, the curved surface being represented by a plurality of logarithmic spiral curved lines which lie in an x-y plane of a polar coordinate system and which are represented according to the polar coordinate system by $r=a_i e^{k\theta}$, the polar coordinate system having a deflection center of the electron beam as an origin, an x-axis being a center axis through the origin, a y-axis extending through the origin and intersecting the x-axis in a direction of vertical deflection at right angles with the x-axis, each of the logarithmic spiral curves lines extending from the origin and passing through a point on the x-axis at a distance $a_i$ from the origin, the distance $a_i$ being a parameter and having a relation of $a_{i+1} > a_i (i=0, 1, 2, \ldots)$, and $k=1/\tan \phi$ where $\phi$ is the angle of incidence, the curved surface having a shape obtained by rotating each of the logarithmic spiral curved lines about the y-axis through an angle $\alpha_i$ having the relation of $\alpha_{i+1} > \alpha_i$ where $\alpha_0=0$ so that the electron beam is made incident at a constant angle at any point on the phosphor screen, a raster of the electron beam being produced in a substantially trapezoidal shape free from vertical deflection when the phosphor screen is scanned with the electron beam.

2. A flat CRT as defined in claim 1 wherein the curved surface is generated by rotating each logarithmic spiral curved line through an angle $\alpha_i$ having the relation of $a_i = 1/\cos \alpha_i \cdot a_0$.

3. A flat CRT as defined in claim 1 which is a black-and-white picture tube.

4. A flat CRT as defined in claim 1 which is a color picture tube.

5. A flat CRT as defined in claim 4 wherein the phosphor screen comprises index phosphor stripes and red, green, blue primary color phosphor stripes arranged in a definite relation to the index phosphor stripes, the index and color phosphor stripes being formed on the inner surface of a wall of a flat glass tube serving as the base.

6. A flat CRT as defined in claim 5 wherein the index phosphor stripes are longer than the primary color phosphor stripes.

7. A flat CRT as defined in claim 6 wherein the index phosphor stripes are about 1 to about 3% longer than the primary color phosphor stripes.

8. A method of fabricating a CRT phosphor screen inclined with respect to a center axis of an electron beam, the steps comprising:

defining a shape of an inner surface of a glass tube wall, which serves as the base of the phosphor screen, by rotating a plurality of logarithmic spiral curves present on an X-Y plane of a polar coordinate system;

defining the polar coordinate system as having a deflection center of the electron beam as an origin;

defining an X-axis as being the center axis through the origin;

defining the Y-axis as extending through the origin and intersecting the X-axis in a direction of vertial deflection at right angles with the X-axis;

extending each of the logarithmic spiral curves from the origin;

passing each of the logarithmic spiral curves through a point on the X-axis at a distance $a_i$ from the origin;

representing the logarithmic spiral curves according to the polar coordinate system of $r=a_i e^{k\theta}$ wherein the distance $a_i$ is a parameter and has the relation of $a_{i+1}>a_i (i=0, 1, 2, \ldots)$, and $k=1/\tan \phi$ where $\phi$ is the angle of incidence;

rotating each of the spiral logarithmic curves about the y-axis through an angle $\alpha_i$ having the relation of $\alpha_{i+1}>\alpha_i$ where $\alpha_0=0$ to define the inner surface;

converting the defined inner surface shape into a mold;

pouring glass into the mold to form the inner surface;

applying phosphors to the inner surface;

applying nonluminescent substance and index phosphor stripes on the tube wall inner surface;

interposing the nonluminescent substance between the index phosphor stripes; and repeatedly arranging red, green, blue primary color phosphor stripes having a sufficient thickness at a spacing on the nonluminescent substance in a definite relation to the index phosphor stripes.

9. A method as defined in claim 8 further including the steps of covering the phosphor screen entirely with a protective transparent thin film, and covering the protective film with an electrically conductive transparent film.

10. A method of defined in claim 8 further including the step of rotating the logarithmic spiral curves about the y-axis through an angle $\alpha_i$ having the relation of $a_i=1/\cos \alpha_i \cdot a_0$.

* * * * *